US006845955B1

(12) United States Patent
Hsu

(10) Patent No.: US 6,845,955 B1
(45) Date of Patent: Jan. 25, 2005

(54) TELESCOPIC STICK

(75) Inventor: Ben Hsu, Changhua Hsien (TW)

(73) Assignee: Ching Feng Blinds Ind. Co., Ltd., Changhua Hsien (TW)

( * ) Notice: Subject to any disclaimer, the term of this patent is extended or adjusted under 35 U.S.C. 154(b) by 0 days.

(21) Appl. No.: 10/660,514

(22) Filed: Sep. 12, 2003

(51) Int. Cl.[7] ..... E04G 25/00

(52) U.S. Cl. ..... 248/200.1; 248/264; 248/268; 211/123

(58) Field of Search ..... 248/214, 227.4, 248/254, 262, 267, 264, 268, 251; 211/123, 124, 105.1, 105.3, 105.5, 105.6

(56) References Cited

U.S. PATENT DOCUMENTS

| | | | | | |
|---|---|---|---|---|---|
| 278,892 | A | * | 6/1883 | Day | 248/262 |
| 457,977 | A | * | 8/1891 | Wilkening | 211/123 |
| 805,570 | A | * | 11/1905 | Maldaner | 248/264 |
| 905,142 | A | * | 12/1908 | Bond | 248/264 |
| 1,284,113 | A | * | 11/1918 | Kroder | 248/262 |
| 1,374,026 | A | * | 4/1921 | Nelson | 211/105.4 |
| 1,752,683 | A | * | 4/1930 | Meagher | 248/251 |
| 1,818,829 | A | * | 8/1931 | Ulbrich | 248/262 |
| 2,657,894 | A | * | 11/1953 | Sklenar | 248/239 |
| 2,973,870 | A | * | 3/1961 | Schoos | 211/123 |
| 2,974,806 | A | * | 3/1961 | Seewack | 211/123 |
| 3,563,182 | A | * | 2/1971 | MacFarlane et al. | 108/29 |
| 3,738,650 | A | * | 6/1973 | Ossenkop et al. | 482/40 |
| 3,865,336 | A | * | 2/1975 | Robertson | 248/235 |
| 3,891,091 | A | * | 6/1975 | Anderson | 211/105.3 |
| 4,473,225 | A | * | 9/1984 | Miller | 482/40 |
| 4,700,918 | A | * | 10/1987 | Andrasko, Jr. | 248/251 |
| 5,894,610 | A | * | 4/1999 | Winter | 4/558 |

* cited by examiner

*Primary Examiner*—Leslie A. Braun
*Assistant Examiner*—A. Joseph Wujciak
(74) *Attorney, Agent, or Firm*—Troxell Law Office PLLC

(57) ABSTRACT

A telescopic stick includes a retaining mount, a supporting sleeve, an inner tube, and an outer tube wherein the retaining mount has a base disposed at one side thereof, a step-wise through hole disposed at the center of the base thereof, a resilient stop block protruding at the upper surface of the base thereof, and a half-tubular abutment plate extending outwards at the lower surface of the base thereof. The supporting sleeve has a circular registration recess defined by an engagement ring and an abutment face of the same diameter at both sides thereof respectively, and a sleeve column with axial flexible ribs distributed thereon to be adapted at the corresponding outer side of the inner and outer tubes therein respectively. In practical use, the inner and outer tubes in sleeve registration are adjusted of length in horizontal direction, and the supporting sleeve is attached to the retaining mount with the resilient stop block abutted tightly against the supporting sleeve for secure location thereon, preventing the inner and outer tubes from coming off there-from when pushed or pulled by outer force.

1 Claim, 5 Drawing Sheets

TELESCOPIC STICK

BACKGROUND OF THE INVENTION

The present invention is related to a telescopic stick, including a retaining mount, a supporting sleeve, an inner tube and an outer tube wherein the retaining mount has a base disposed at one side thereof, a step-wise through bole disposed at the center of the base thereof, a resilient stop block protruding at the upper surface of the base thereof, and a half-tubular abutment plate extending outwards at the lower surface of the base thereof. The supporting sleeve has a circular registration recess defined by an engagement ring and an abutment face of the same diameter at both sides thereof respectively, and a sleeve column with axial flexible ribs distributed thereon to be adapted at the inner and outer tubes therein respectively; whereby, the inner and outer tubes in sleeve engagement are adjusted of length in horizontal direction, and the supporting sleeve is securely located onto the retaining mount in assembly, preventing the inner and outer tubes from coming off there-from when pushed or pulled by outer force.

Please refer to FIG. 1. A conventional telescopic stick 10 is made up of an inner tube 11, an outer tube 12, a flexible linking unit 13, a first extending coupling part 14, an extending tube 15, and a second extending coupling part 16. The flexible linking unit 13 having a releasing end 131 and a base end 132 is adapted at the inner tube 11 therein and fixedly attached to one side of the inner and outer tubes 11, 12 thereof respectively by both ends thereof. The inner tube 11 is joined to the outer tube 12 therein in sleeve registration, and the first extending coupling part 14 is located at the space defined by one end of the outer tube 12 and the base end 132 of the flexible linking unit 13 thereof. The first extending coupling part 14, a screw joint member, has a plurality of claw plates 141 disposed at sides thereof for secure location at the inner wall of the outer tube 12 thereof. The extending tube 15 is provided with a coupling end 151 disposed at one side thereof to be located at one end of the outer tube 12 therein. The second extending coupling part 16 also has a plurality of claw means 161 disposed at both sides thereof correspondingly matched to the first extending coupling part 14 for secure location at the inner wall of the coupling end 151 of the extending tube 15 therein. The first and the second extending coupling parts 14, 16 are mutually joined in screw registration to engage the extending tube 15 and the outer tube 12 therewith.

There are some drawbacks to such conventional telescopic stick 10. First, the assembly parts of the telescopic stick 10 are uneconomically numerous and complex in assembly, which increase not only the cost of materials but also that of processing as well. Second, the telescopic stick 10 is rotated either clockwise or counterclockwise to adjust its length to suit the width of a door/window frame A. In assembly, the telescopic stick 10 is first rotated to one side for a certain length to know if the telescopic stick 10 is adjusted in the right direction. Once rotated in the wrong direction, the telescopic stick 10 must be readjusted in the opposite direction to get the right length in assembly. Thus, it's quite inaccurate and inconvenient in terms of operation thereof. Third, the telescopic stick 10 is simply abutted against the wall of the door/window frame A by both ends thereof. In case children pull at the blinds, the telescopic stick 10 influenced by the outer force can easily come off from the wall thereof. Thus, besides the trouble of reassembly, the telescopic stick 10 also poses a danger to children in the household.

Please refer to FIG. 2. A second conventional telescopic stick 20 comprises a base tube 21, an extensible tube 22, a coupling sleeve 23, a compressing spring 24, a stop member 25, and an outer cap 26. The extensible tube 22 is adjustably adapted at one sided of the base tube 21 therein with an eccentric locking device (not shown in the figure) joined at one inner end thereof which is rotated to one side, pressing the inner wall of the base tube 21 to be securely engaged with the extensible tube 22 thereof. Otherwise, the eccentric locking device thereof is rotated to the opposite direction for the extensible tube 22 to be freely adjusted at the base tube 21 therein. The coupling sleeve 23, located at the other side of the base tube 21 therein, has an inner tube 231 and an outer tube 232 disposed at the center thereof and defining a ring registration recess 233 therein for a registration end 241 of the compressing spring 24 to be engaged therewith and an acting spring 242 thereof to be protruded out of the coupling sleeve 23 thereof. The stop member 25 has a circular stop plate 251 of a larger diameter disposed at one end for the top end of the acting spring 242 to be abutted thereto. At the inner center of the stop member 25 is disposed a fastening rod 252, passing through the compressing spring 24 and the base tube 21 to be fixedly located at the bottom end of the inner tube 231 thereof via a fastening hook 2521 thereof. The outer cap 26 is applied onto the outer side of the stop member 25 and the compressing spring 24 thereof to complete the assembly thereof.

There are some disadvantages to the second conventional telescopic stick 20. First, the assembly parts of the telescopic stick 20 are numerous and complex in assembly, uneconomically increasing the costs of materials and processing as well. Second, the telescopic stick 20 is uncertainly rotated either clockwise or counterclockwise to adjust its length to suit the width of a door/window frame A, which is quite troublesome and inconvenient in operation thereof. Third, the telescopic stick 20 is simply abutted against the wall of the door/window frame A by the outer cap 26 disposed at both ends thereof respectively. Once influenced by outer force such as pulled by children, the telescopic stick 20 can easily come off from the wall thereof, which, besides the trouble of reassembly, is insecurely unsafe to children in the household.

SUMMARY OF THE PRESENT INVENTION

It is, therefore, the primary purpose of the present invention to provide a telescopic stick, including a retaining mount, a supporting sleeve, an inner tube and an outer tube, which is reduced in assembly parts, economically saving the costs of materials and processing as well as facilitating a fast and easy assembly thereof.

It is, therefore, the secondary purpose of the present invention to provide a telescopic stick wherein the inner and outer tubes are adjusted of length by either pushing or pulling thereof in horizontal direction to withdraw or extend the telescopic stick to suit the width of a door/window frame, facilitating an accurate and easy operation of the telescopic stick in adjustment thereof.

It is, therefore, the third purpose of the present invention to provide a telescopic stick wherein the supporting sleeve is led to a base of the retaining mount screwed up to the wall of the window/door frame from top to bottom, pressing downwards a resilient stop block of the base thereof to tightly abut against the upper surface of the supporting sleeve till a circular registration recess and an engagement ring of the supporting sleeve thereof engaged with an arc registration rib and an engagement cavity of the base thereof respectively for secure location of the supporting sleeve and both ends of the engaged inner and outer tubes thereto, preventing the inner and outer tubes from coming off there-from when pushed or pulled by outer force.

DETAILED DESCRIPTION OF THE PREFERRED EMBODIMENTS

Figure 1:
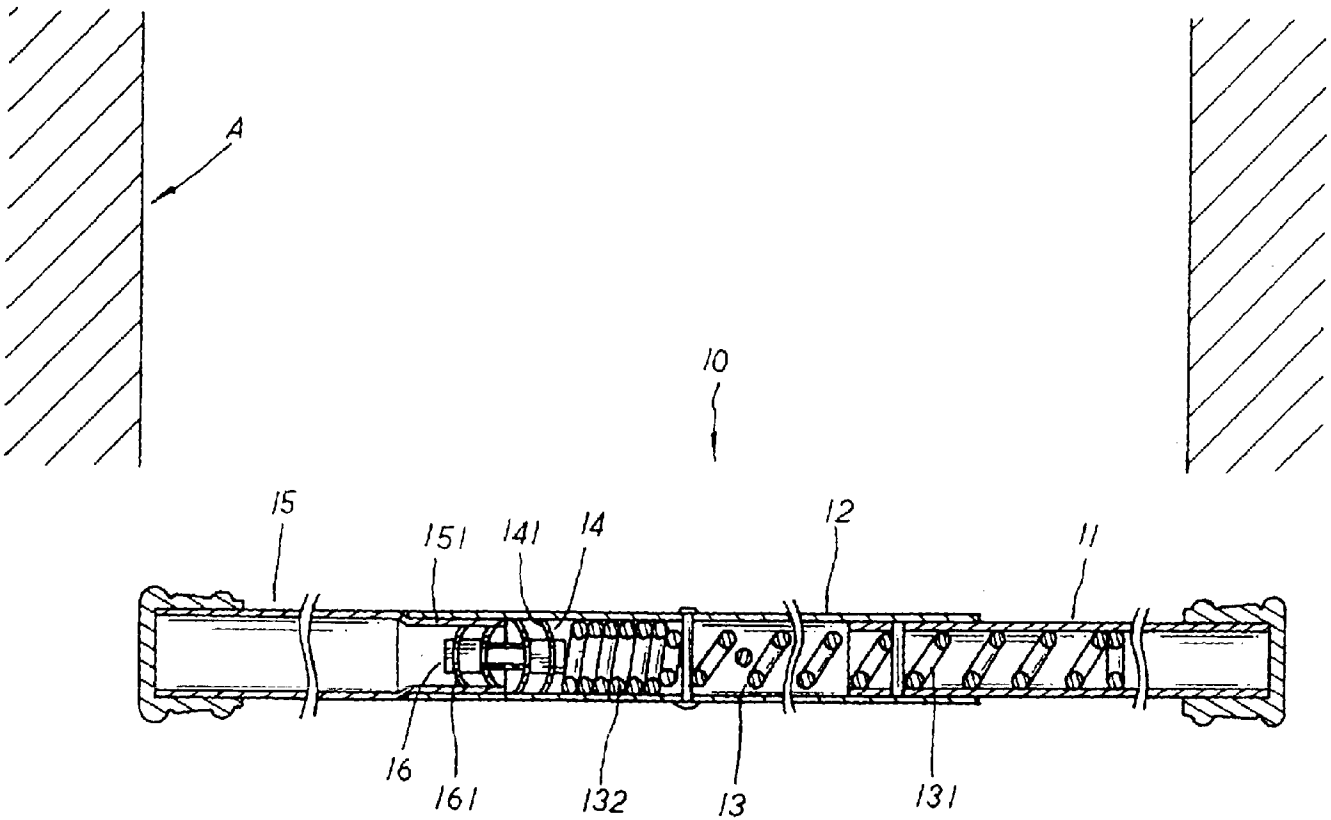
FIG. 1 PRIOR ART
FIG. 1 is a diagram showing a conventional telescopic stick in practical use.
Figure 2:
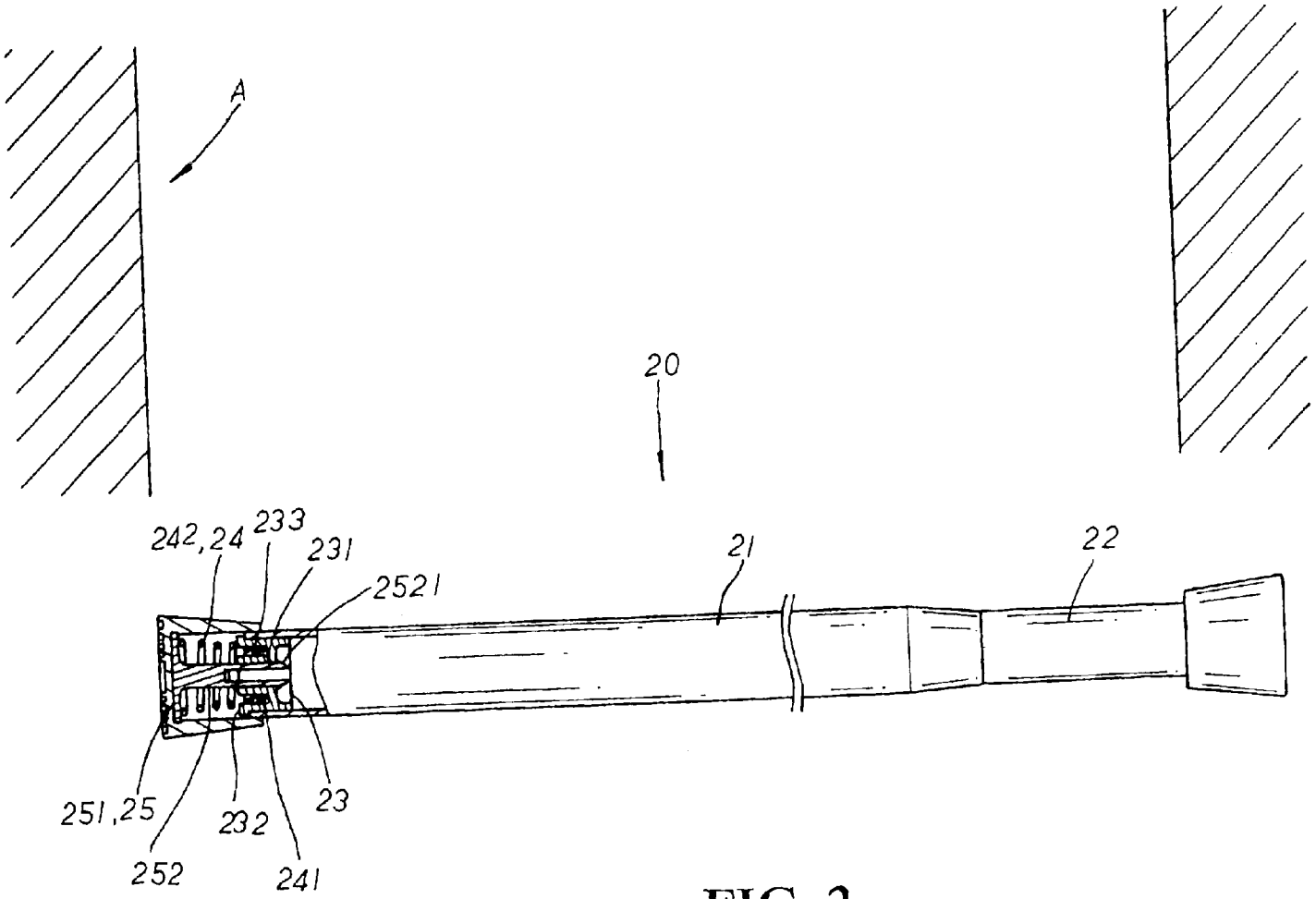
FIG. 2 PRIOR ART
FIG. 2 is a diagram showing another conventional telescopic stick in use.
Figure 3:
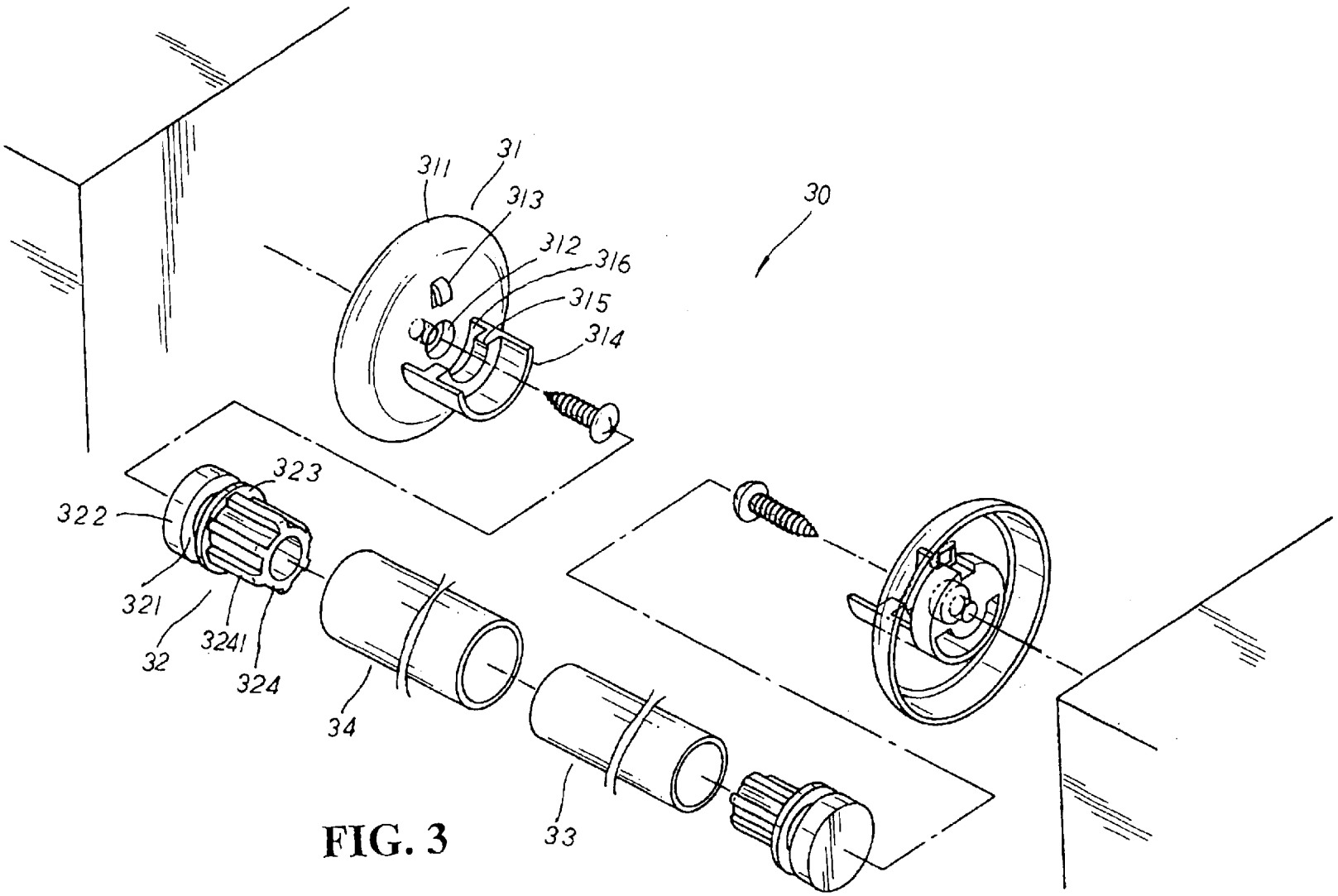
FIG. 3 is a perspective exploded view of the present invention.

Please refer to FIG. 3. The present invention is related to a telescopic stick 30, including a retaining mount 31, a supporting sleeve 32, an inner tube 33, and an outer tube 34. The retaining mount 31 is made up of a base 311 disposed at one side thereof, a step-wise through hole 312 disposed at the center of the base 311 thereof, a resilient stop block 313 protruding at the upper surface of the base thereof, and a half-tubular abutment plate 314 extending outwards at the lower surface of the base thereof. The half-tubular abutment plate 314 has an arc registration rib 315 protruding properly at the inner side thereof, and an engagement groove 316 defined by the arc registration rib 315 and the base therebetween. The supporting sleeve 32 has a circular registration recess 321 indented properly at one side thereof, an engagement ring 322 and an abutment face 323 of the same diameter protruding at both sides of the circular registration recess 321 thereof respectively, and a sleeve column 324 with axial flexible ribs 3241 distributed at the outer periphery thereon extending at the other side thereof. The outer diameter of the sleeve column 324 thereof is properly matched to the inner and the outer tubes 33, 34 thereof.

Figure 4:
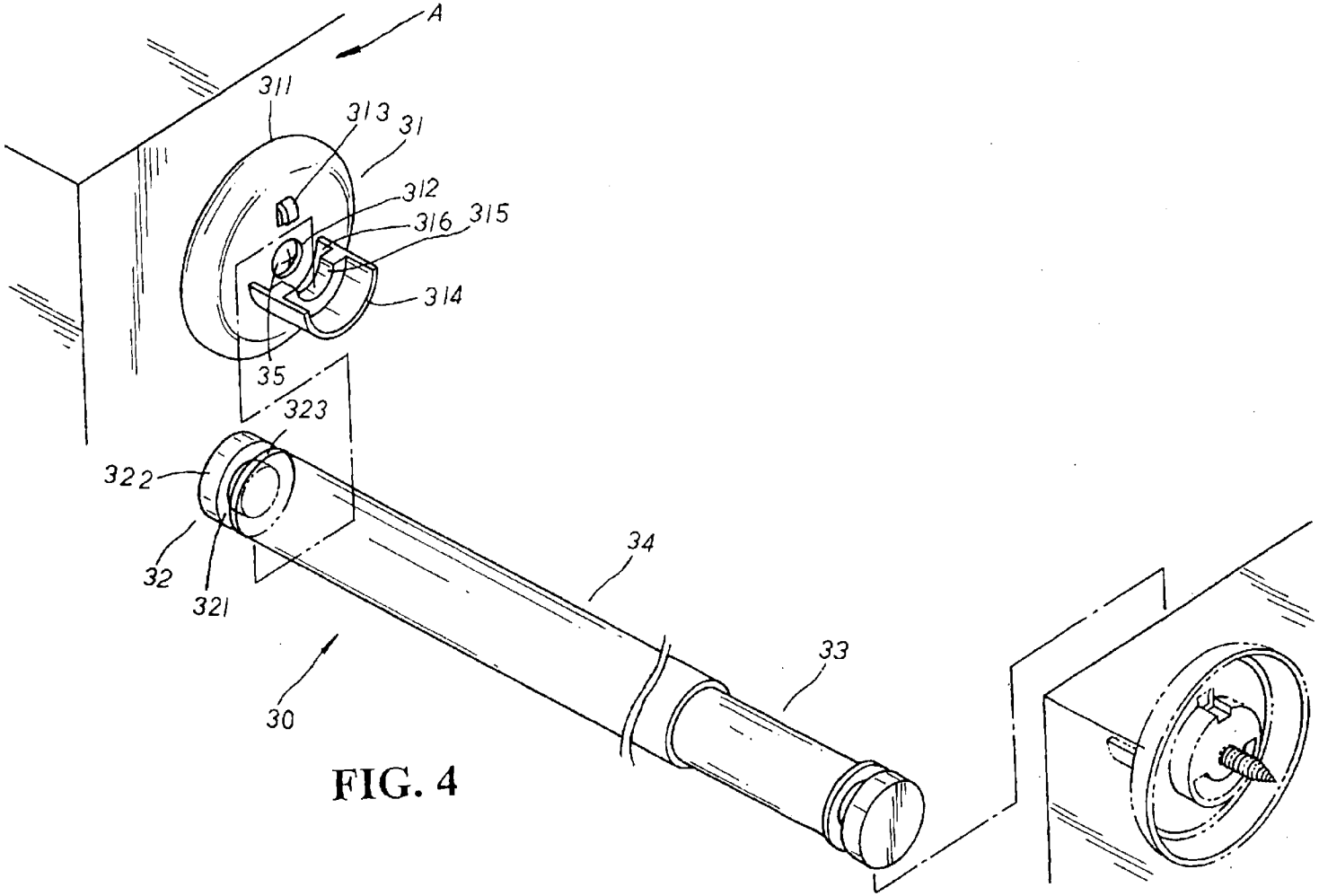
FIG. 4 is a perspective view of the present invention in assembly.

Please refer to FIG. 4. In assembly, the retaining mount 31 is properly applied onto the wall of a window/door frame A and securely fixed thereto via a screw bolt 35 led through the step-wise through hole 312 thereof for screw lock of the retaining mount 31 onto the wall thereof. The inner tube 33 is registered with the outer tube 34 in sleeve joint before the sleeve column 324 of the supporting sleeve 32 is pressure pushed into the corresponding outer side of the inner and the outer tubes 33, 34 thereof respectively till the abutment face 323 thereof stopped at both ends thereon respectively. Thus, the axial flexible ribs 3231 are tightly abutted against the inner wall of the inner and outer tubes 33, 34 therein to complete the assembly thereof.

Figure 5:
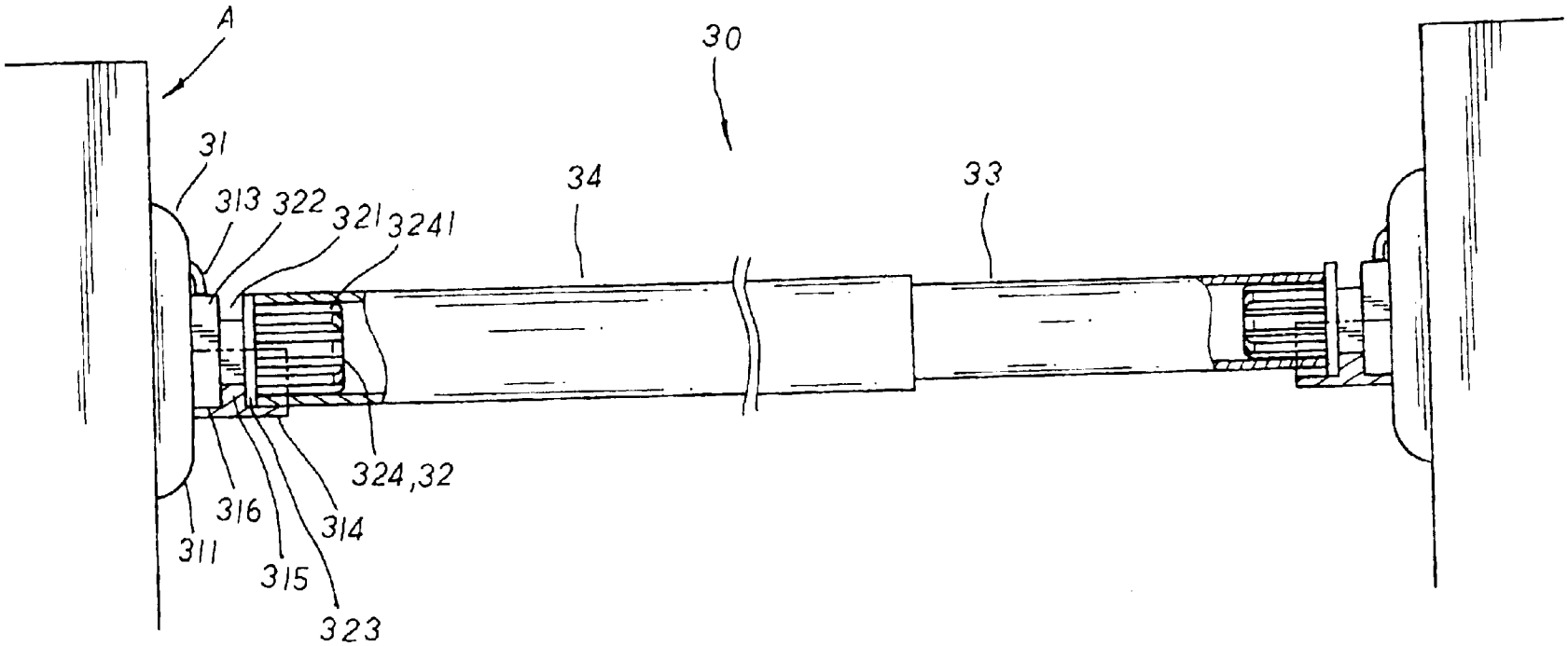
FIG. 5 is a sectional view of the present invention in practical use.

Please refer to FIG. 5. In practical use, the inner and outer tubes 33, 34 are adjusted by either pulled or pushed in horizontal direction to extend or withdraw into a proper length to suit the width of the window/door frame A. The supporting sleeve 32 disposed at both sides thereof respectively is led to the base 31 from top to bottom, pressing downwards the resilient stop block 313 till the circular registration recess 321 thereof engaged with the arc registration rib 315 of the base 31 and the engagement ring 322 adapted at the engagement cavity 316 of the base 31 therein for secure location thereof. With the resilient stop block 313 thereof tightly abutted against the upper surface of the supporting sleeve 32, the supporting sleeve 32 and both ends of the inner and outer tubes 33, 34 are securely located at the retaining mount 31 thereof, preventing the inner and outer tubes 33, 34 from coming off upwards or downwards there-from when pushed or pulled by outer force.

What is claimed is:

1. A telescopic stick, including a retaining mount, a supporting sleeve, an inner tube, and an outer tube, and being characterized by that;

the retaining mount being made up of a base disposed at one side thereof, a step-wise through hole disposed at the center of the base thereof, a resilient stop block protruding at the upper surface of the base thereof, a half-tubular abutment plate extending outwards at the lower surface of the base thereof, an arc registration rib protruding properly at the inner side of the half-tubular abutment plate thereof, and an engagement groove defined by the arc registration rib and the base therebetween;

the supporting sleeve having a circular registration recess indented properly at one side thereof, an engagement ring and an abutment face of the same diameter protruding at both sides of the circular registration recess thereof respectively, and a sleeve column with axial flexible ribs distributed at the outer periphery thereon extending at the other side thereof wherein the outer diameter of the sleeve column thereof is properly matched to the inner and the outer tubes thereof;

in practical use, the inner and outer tubes in sleeve registration are adjusted by either pulled or pushed in horizontal direction to be extended or withdrawn into a proper length to suit the width of a window/door frame; the supporting sleeve is led to the base screwed up to the wall of the window/door frame from top to bottom, pressing downwards the resilient stop block to tightly abut against the upper surface of the supporting sleeve till the circular registration recess and the engagement ring of the supporting sleeve engaged with the arc registration rib and the engagement cavity of the base thereof respectively for secure location of the supporting sleeve and both ends of the inner and outer tubes onto the retaining mount, preventing the inner and outer tubes from coming off there-from when pushed or pulled by outer force.

* * * * *